US005537766A

United States Patent [19]

Nickens et al.

[11] Patent Number: 5,537,766

[45] Date of Patent: Jul. 23, 1996

[54] TRADE SHOW DISPLAY PANELS AND DISPLAY PANEL SYSTEMS AND METHODS FOR INTERCONNECTING THE DISPLAY PANEL SYSTEMS

[75] Inventors: Lowell W. Nickens, Portland; Ronald E. Newton, Dalles, both of Oreg.

[73] Assignee: Classic Exhibits Inc., Milwaukie, Oreg.

[21] Appl. No.: 198,045

[22] Filed: Feb. 17, 1994

[51] Int. Cl.[6] ..... G09F 15/00

[52] U.S. Cl. ..... 40/605; 40/610; 160/135

[58] Field of Search ..... 40/610, 605; 160/135, 160/229.1, 391; 52/71; 16/354

[56] References Cited

U.S. PATENT DOCUMENTS

| | | | |
|---|---|---|---|
| 4,056,985 | 11/1977 | Worrallo | 16/135 |
| 4,443,911 | 4/1984 | Bannister | 160/135 |
| 4,624,083 | 11/1986 | Diffrient | 16/354 |
| 4,825,930 | 5/1989 | Lindberg et al. | 160/135 |

FOREIGN PATENT DOCUMENTS

| | | | |
|---|---|---|---|
| 1542244 | 3/1979 | United Kingdom | 16/354 |

*Primary Examiner*—Kenneth J. Dorner

*Assistant Examiner*—Cassandra Davis

*Attorney, Agent, or Firm*—Marger, Johnson, McCollom & Stolowitz

[57] ABSTRACT

A portable trade show display panel system is provided including a plurality of display panels, the system being readily manually transportable by an end user. The system comprises a plurality of panel members, elongate hinge members attached to the sides of adjacent panel members for rotational movement by at least one adjacent panel member with respect to the other about the longitudinal axis of the elongate hinge members. A protective outer covering surrounds each panel member and elongate hinge member forming display panels. The protective outer covering is connected to the panel members by frictional engagement within the confines of the longitudinally-extending slots. Finally, a device for interconnecting adjacent display panels one to the other is provided. In this way fixed, aligned positioning of the adjacent display panels one with respect to each other will occur while also facilitating rotational movement of the adjacent display panels about the longitudinal axis of the elongate hinge members so that the portable trade show display panel system can be arranged in a stable upright position for visual inspection by trade show participants.

27 Claims, 4 Drawing Sheets

TRADE SHOW DISPLAY PANELS AND DISPLAY PANEL SYSTEMS AND METHODS FOR INTERCONNECTING THE DISPLAY PANEL SYSTEMS

BACKGROUND OF THE INVENTION

This invention relates to portable trade show display panels, to display panel systems and to methods for interconnecting the display panel systems, particularly portable exhibit trade show display panels that are readily manually transportable by an individual end user.

A typical prior art portable exhibit trade show display panel system comprises individual display panels formed of an externally-attached exposed frame member joined by wood screws to a hardwood base surrounded by a fabric covering. The individual display panels are interconnected one to the other for rotational movement about their longitudinal axis via externally-attached exposed hinge members. Thus, in these types of prior art display panel systems, the frame members and the hinges are visible to trade show participants during use.

In recent years, the trade show industry has indicated a desire for portable display panel systems which do not have exposed frame members and hinges. Instead, these systems are aesthetically designed so that only the fabric covering of the display panels is visible during use.

However, prior art portable systems of this latter type employ interconnectors which do not provide fixed, aligned positioning of adjacent display panels with respect to each other. Therefore, these display panel system cannot be carried into a trade show and arranged in a stable vertical location for visual inspection by trade show participants. Furthermore, the use of expensive wooden frame members are necessary in order to facilitate attachment of the fabric covering through the use of fasteners such as metal screws or nails and/or adhesives. The use of wooden frame members and fasteners adds significant cost and structure to the fabrication of these prior art systems.

Accordingly, a need exists for a portable display panel systems which are aesthetically designed so that only the fabric covering of the display panels is visible during use and which employ interconnectors which provide fixed, aligned positioning of adjacent display panels with respect to each other without the use of expensive wooden frame members to facilitate attachment of the fabric covering, and without the use of fasteners such as metal screws or nails and/or adhesives, so that the display panel system can be carried into a trade show and arranged in a stable vertical location for visual inspection by trade show participants.

SUMMARY OF THE INVENTION

The portable trade show display panel system of the present invention overcomes the above-described problems which exist in the prior art. First, individual display panels are not interconnected one to the other for rotational movement about their longitudinal axis via externally-attached exposed hinge members. Second, the subject display panel systems employ interconnectors which do provide fixed, aligned positioning of adjacent display panels with respect to each other. Third, only the fabric covering of the display panels is visible during use, not the structural interstices. Next, the display panel system of the present invention can be fabricated without the use of fasteners such as metal screws or nails and/or adhesives. Finally, the display panel system can be readily carried into a trade show and arranged in a stable vertical location for visual inspection by trade show participants.

The subject portable trade show display panel system includes a plurality of unique display panels, elongate hinge members means for interconnecting the display panels. More specifically, the system comprises a plurality of panel members. Each panel member comprises first and second substantially parallel longitudinally-extending sides and first and second substantially parallel laterally-extending end sections. Preferably, the panel members include means defining grooves extending within at least one of the longitudinally-extending sides for attachment of the elongate hinge members to the adjacent longitudinally-extending sides of adjacent panel members for rotational movement by at least one adjacent panel member. To facilitate the portable nature of the system, the panel members can be fabricated of a lightweight rigid board material.

The system of the subject invention also includes an elongate hinge member. Each elongate hinge member has a longitudinal axis and includes means defining a longitudinally-extending channel. The elongate hinge members is attached to an adjacent longitudinally-extending sides of adjacent panel members for rotational movement by at least one adjacent panel member with respect to the other about the longitudinal axis of the elongate hinge members. The elongate hinge members can also include flange means attachable to the longitudinally-extending sides of the panel members within the groove means. The elongate hinge members each preferably includes means defining a longitudinally-extending elongate slot. Means for interconnecting adjacent display panels, such as fasteners or the like, are preferably sized to securely fit within the confines of the elongate slot means. To facilitate the connection of the protective outer covering to the panel members, the elongate hinge members can include a plurality of longitudinally-extending elongate rib members located on the outer periphery of the hinge members.

A protective outer covering surrounds the panel member and the elongate hinge member forming a display panel. In this way, the panel member and the elongate hinge members are not exposed during use. The protective outer covering is connected to the panel members by frictional engagement within the confines of the longitudinally-extending slots. Preferably, the protective outer covering is connected to the panel members solely by frictional engagement within the confines of the longitudinally-extending channels.

Finally, the display panel system of the present invention includes means for interconnecting adjacent display panels one to the other. This provides fixed, aligned positioning of the adjacent display panels one with respect to each other. It also facilitates rotational movement of the adjacent display panels about the longitudinal axis of the elongate hinge members so that the portable trade show display panel system can be arranged in a stable upright position for visual inspection by trade show participants. The system can also be fabricated so that the means for interconnecting adjacent display panels one to the other comprises means for attaching an elongate hinge member of one panel member to the elongate hinge member of an adjacent panel member. Preferably, the means for interconnecting elongate hinge members of adjacent display panels comprises fasteners secured to the elongate hinge members and link members connected to and joining adjacent fasteners in adjacent display panels one to the other.

In a preferred form of this invention, a first adjacent display panel is rotationally movable in an arcuate path about the longitudinal axis of a second adjacent display panel. The extent of the arcuate path is from a first position wherein a first longitudinally-extending side of a first display panel member is adjacent and substantially parallel to a first longitudinally-extending side of a second display panel, to a second position wherein a first longitudinally-extending side of the first display panel is adjacent and substantially parallel to a second longitudinally-extending side of the second display panel the display panel system can be carried into a trade show and arranged in a stable vertical location for visual inspection by trade show participants.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
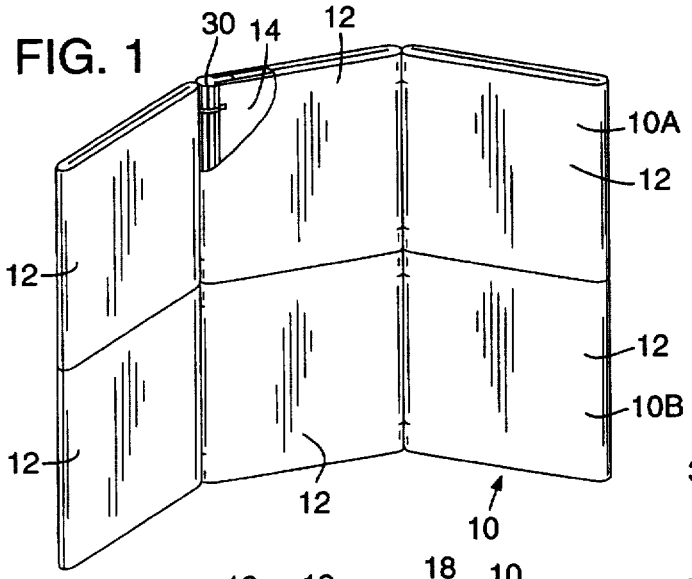
FIG. 1 is a perspective view of a pair of portable trade show display panel systems of the present invention attached one atop the other.
Figure 3:
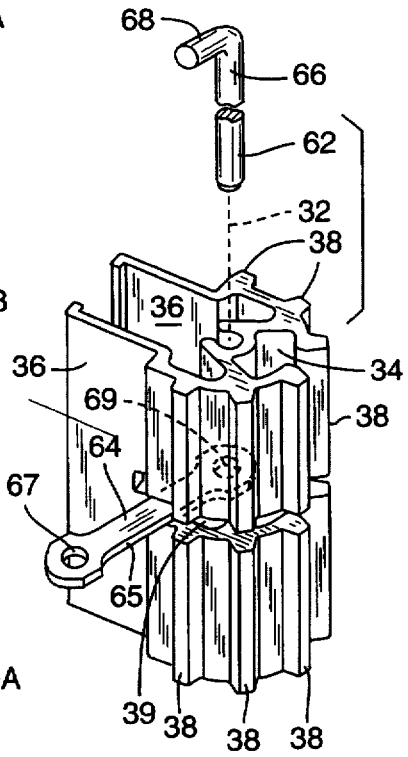
FIG. 3 is an enlarged exploded perspective view of a portion of an elongate hinge member and the fastener and link members which are employed for interconnecting adjacent display panels.

Referring now to FIGS. 1–10, a portable multi-level display panel system 10 is provided for displaying information attached thereto (not shown) concerning a company or organization to others particularly at trade shows. The system 10 comprises upper and lower portable trade show display panel systems 10A and 10B of this invention each includes a plurality of display panels 12 which are pivotally interconnected one to the other. Systems 10A and 10B are shown in FIG. 1 in position one atop the other.

Systems 10 and 10' are readily manually transportable by an end user for use at a trade show or the like. Typically, systems 10 and 10', in the retracted or folded position (see FIGS. 6 and 8), are stored and transported in a portable carrier such as the Classic One Step Display carrier from Classic Exhibits, Inc. of Milwaukie, Oreg.

Referring to FIGS. 5–8, each display panel 12 comprises a panel member 14 comprising first and second substantially parallel longitudinally-extending sides 16 and first and second substantially parallel laterally-extending end sections 18. Panel member 14 is formed of a lightweight high density rigid composite board material, typically a rigid polymeric foam material. More particularly, as depicted in FIGS. 5–9, the composite board material comprises Gator Foam™, a rigid board material manufactured by International Paper Company of Statesville, N.C., which is comprised of a high density rigid polymeric inner foam material 20 and paper laminate outer protective sheets 22. Grooves 24 have been machined into the foam material 20 which forms the sides 16 (and end sections 18 not shown) of panel member 14. These grooves 24 receive the hereinafter described elongate hinge members 30 and facilitate the attachment of the elongate hinge members to the panel members 14.

Figure 2:
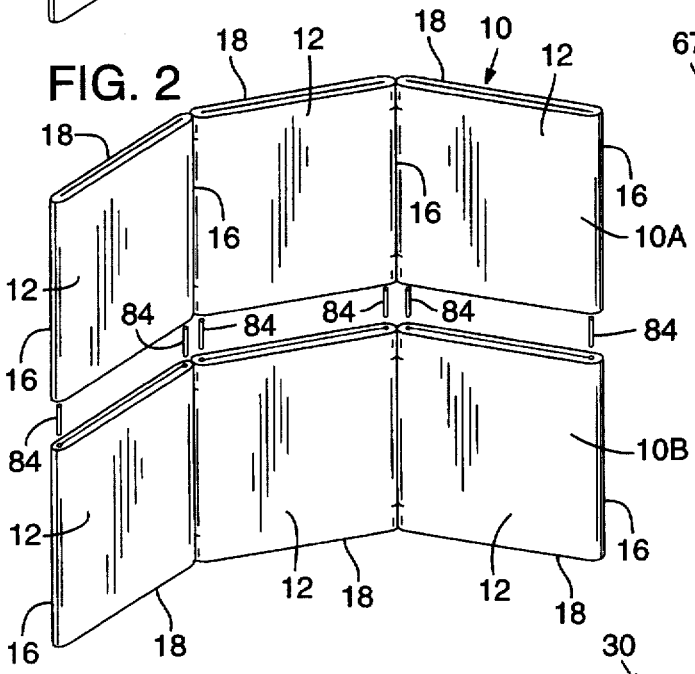
FIG. 2 is perspective exploded view of the portable trade show display panel systems of FIG. 1.

In FIG. 2, systems 10A and 10B are depicted in an exploded view in order to expose the means for joining system 10A in a fixed position atop system 10B. As shown in detail in FIGS. 9 and 10 the manner in which system 10A and 10B are joined one to the other is depicted. As particularly seen in FIG. 10, wood strips 70 are located in groove 24 in foam material 20 in the bottom of panel member 14 of system 10A and in the top of panel member 14 of system 10B. The wood strips 70 are held in position by a force fit imparted by sides 16. An elongate metal channel member 72 is provided in each system 10 and **10*a* which comprises respective elongate inner and outer horizontal sections 74 and 78 and sidewalls 76. The outer section 78 has an elongate slit 80 located therein for receiving and maintaining the ends of protective outer covering 50 therewithin. The metal channel members 72, which are typically aluminum in construction and of similar dimension to wood strip 70, are introduced into groove 24 so that inner horizontal section 74 rests on wood strip 70. At predetermined intervals, unthreaded orifice 82 and threaded orifice 83 are drilled into the woods strips 70 and 71 of respective systems 10A and 10B. The orifices 82 and 83 are in vertical alignment with slit 80, are sized to receive a pin 84 and to maintain pin 84 in a fixed position. Pin 84 has a threaded ends 86 and non-threaded end 88. When pin 84 is located in position with threaded end 86 within threaded orifice 82, it passes through an aperture 90 in floor section 74 and extends upward in a fixed, substantially vertical position. Pin 84 is held in a fixed position within threaded orifice 82 by a nut 85 which extends through aperture 90 into a recess 75 within wood strip 70 of system 10B. Aperture 90 is in vertical alignment with threaded orifice 82 and slit 80. Threaded pin 84 exits through slit 80 so that end 88 extends from the top of display panel 12 into orifice 83 of display panel 10A thereby maintaining display panel system 10A in a fixed position atop display panel system 10B**.

Referring to FIGS. 3, 5–9, elongate hinge members 30 are provided and are attached to the longitudinally-extending sides 16 of panel members 14 within grooves 24. More specifically, the elongate hinge members 30 include a pair of flange members 36 which serve as the means of attachment of panel members 14 so that they are sized to fit within grooves 24 so that they can be secured against the interior of longitudinally-extending sides 16. Each elongate hinge member 30 has a longitudinal axis 32 (see FIG. 3) which defines the axis of rotation of the respective display panels 12 one with respect to the other.

Figure 4:
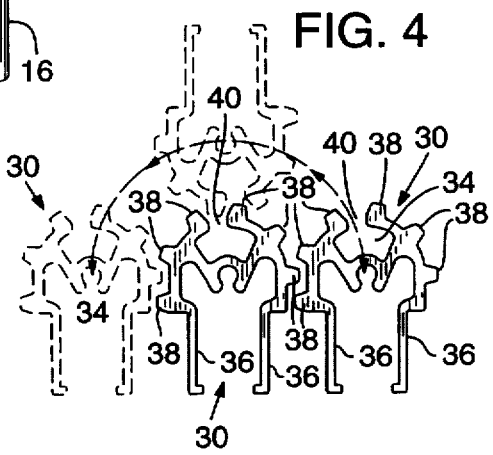
FIG.4 is an enlarged plan view of a pair of adjacent elongate hinge members of FIG. 3 in which the movement of one of the hinge members from a first position, in an acute path about the other hinge member, to a second and third position depicted in phantom.
Figure 4A:
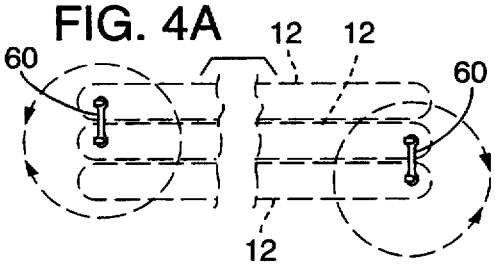
FIG.4A is a schematic, plan view showing the display panels of FIG. 1 in phantom and in a folded position, the relative movement of the display panels and location of the means for interconnecting the respective display panels also being shown.
Figure 5:
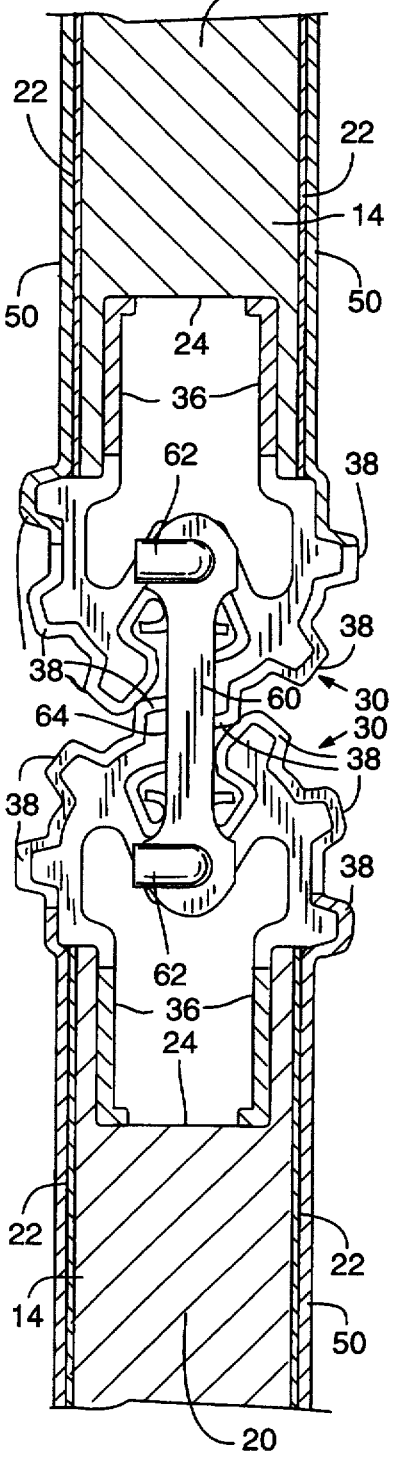
FIG. 5 is an enlarged sectional, plan view of a pair of adjacent portable trade show display panel system of the present invention, including the means for interconnecting these adjacent display panels one to the other, in a fully extended (unfolded) position.
Figure 6:
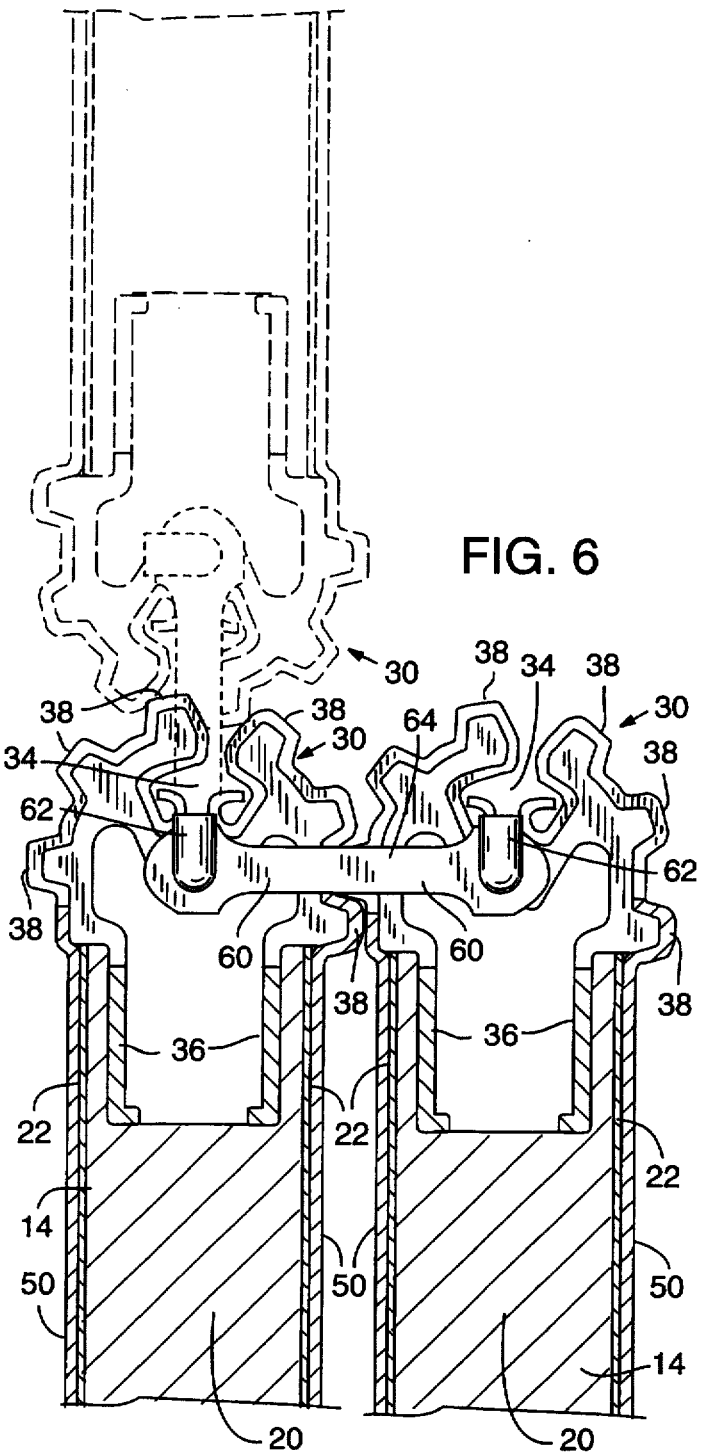
FIG. 6 is the panel system of FIG. 5 which has been moved to a fully retracted (folded) position.
Figure 7:
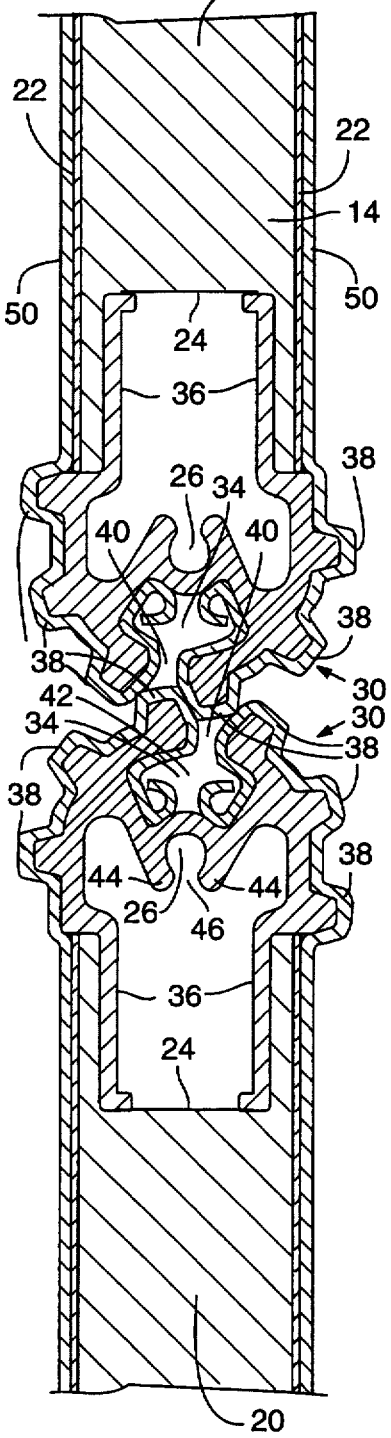
FIG. 7 is the panel system of FIG. 5, in a fully extended (unfolded) position, without the means for interconnecting the adjacent display panels one to the other.
Figure 7:
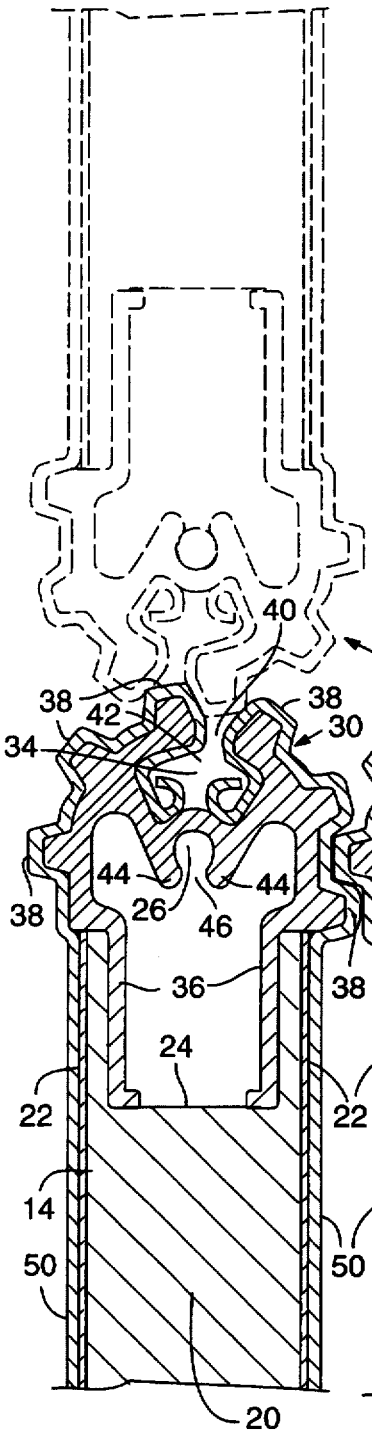
Figure 8:
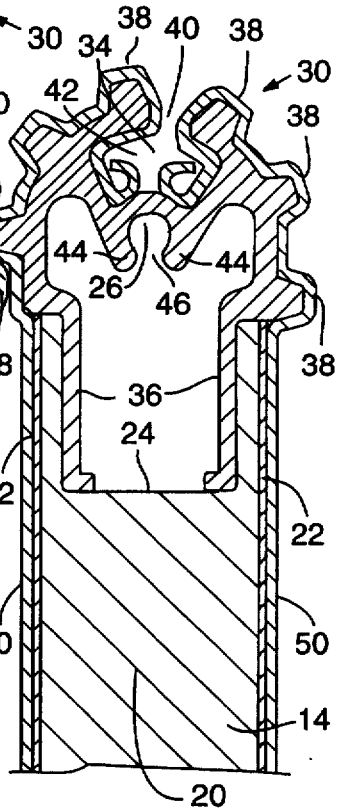
FIG. 8 is the panel system of FIG. 7 which has been moved to a retracted (folded) position.
Figure 9:
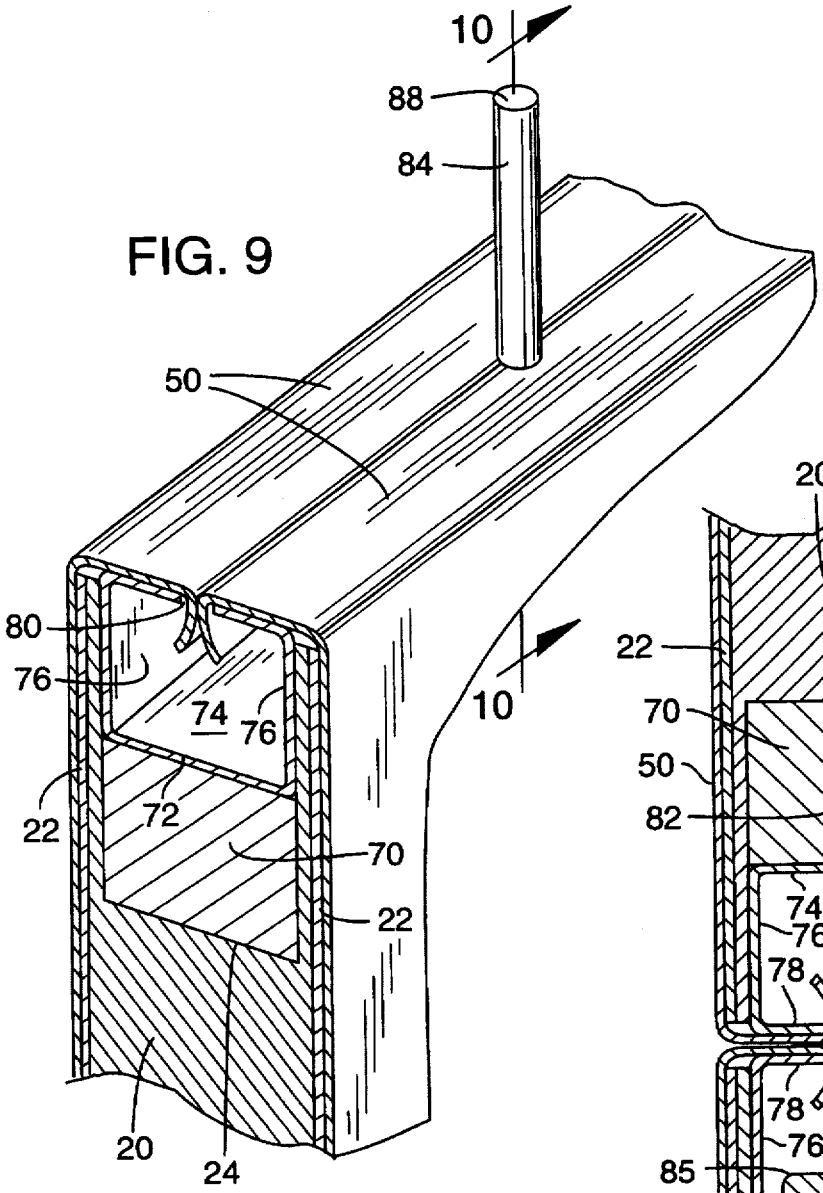
FIG. 9 is an enlarged sectional perspective view of the top of a display panel or display panel system modified for engagement thereatop by another display panel or display panel system.
Figure 10:
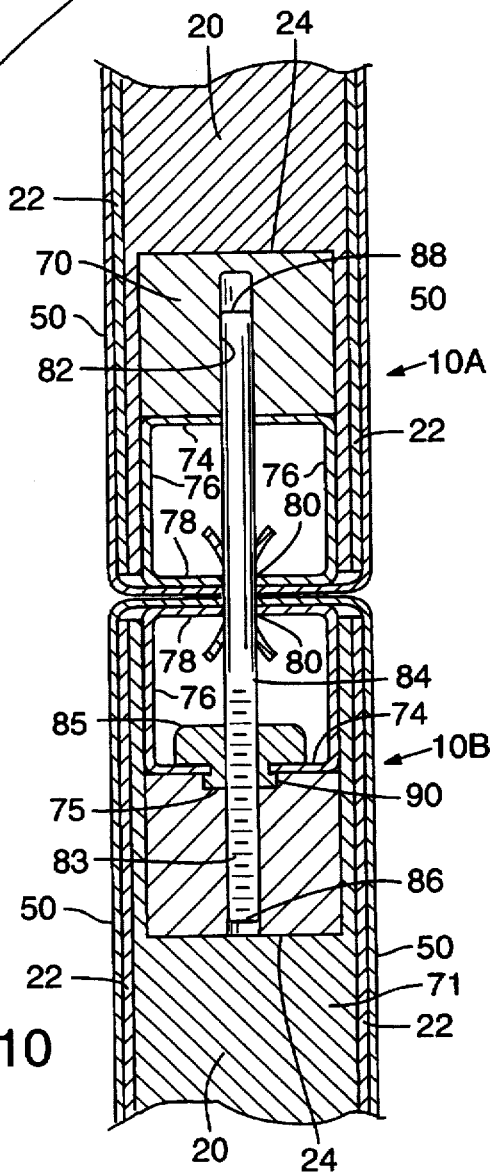
FIG. 10 is a enlarged section view taken along line 10—10 of FIG. 9.

The elongate hinge members 30 also include a plurality of longitudinally-extending elongate rib members 38, forming a general arcuate overall cross-sectional configuration, and located on the outer periphery of the elongate hinge members. Rib members 38 are employed for facilitating the connection of protective outer fabric covering 50 to panel members 14. As seen in FIGS. 4, the rib members 38 of adjacent display panels 12 act as gear teeth with respect to adjacent complementary rib members 38 thereby facilitating the rotational movement of the adjacent display panels with respect to each other. The relative rotational movement of the display panel systems 10A and 10B of FIG. 1 from an extended position to a retracted position as depicted in FIG. 4A is made easier by these rib members 38. At about the apex of the arcuate cross-section, a longitudinally-extending channel 34 is formed for securely receiving protective outer fabric covering 50. The channel 34 comprises a narrowed entry opening 40 and an inner compartment 42. The elongated hinge members 30 further includes a longitudinally-extending elongate slot 26, having a substantially semi-circular cross-section configuration. Slot 26 is located within the interior of the elongated hinge members 30 and is formed within a pair of inwardly-extending arcuate projections 44 having a narrowed opening 46 formed there between. Slot 26 is sized to securely receive fastener 62 which is employed in interconnecting adjacent display panels 14. Slits 39 are cut through the hinge members 30 at predetermined parallel points of entry therein. In this way, link members 64 can be introduced into the interstices of the hinge members through the slits 39 for connection to the fastener 62 extending within slot 26.

A protective outer covering 50 surrounds each panel member 14 and elongate hinge member 30 to form display panels 12, so that the panel member 14 and the elongate hinge members are not exposed during use. In this way, when the portable trade show display panel system 10 or 10' is arranged in a stable upright position, the visual perspective of trade show participants is directed to the decorative outer covering and not to the structural elements of these display panel systems. The protective outer covering 50 is connected to the panel members 14 by frictional engagement of the covering 50 within the confines of longitudinally-extending slots 40, and more particularly, within inner compartment 42. Frictional engagement is also maintained between the covering 50 and the rib members 38. This level of frictional engagement between the covering 50 and the elongate hinge members 30 is sufficient in and of itself to maintain the requisite degree of attachment of the covering with respect to the display panel system. However, although adhesives or fasteners can be employed as auxiliary means of joining of the covering 50 as part of the display panel system, such adhesives or fasteners are not required to affect such attachment.

As clearly depicted in FIGS. 4A–6, a device 60 for interconnecting adjacent display panels 12 and thereby providing fixed, aligned positioning of the adjacent display panels 12 one with respect to each other. Also, as clearly shown in FIGS. 4–6, the device 60 facilitates rotational movement of adjacent display panels 12 about the longitudinal axis 32 of elongate hinge members 30. For example, the device 60 can comprise fasteners 62 secured to the elongate hinge members 30 and link members 64 connected to and joining adjacent fasteners in adjacent display panels one to the other. For example, the fastener 62 can comprise a pin member 66 having a crimped end 68. The link member 64 can comprise a bar member 65 have holes 67 and 69 at its respective ends.

First, elongate hinge members 30 are attached within the sides 16 of a pair of panel member 14. The ends of the link member 64 are introduced into the interstices of the hinge members through slits 71 disposed therewithin. A pair of fasteners 62, in the form of pin members 66, are inserted into both ends 72 of a link member 64 until the crimped ends 68 engage the link member. The other ends of the pin members 66 are then inserted into longitudinally-extending elongate slots 26 of the adjacent hinge members 30. When the adjacent display panels are assembled, it is disposed for rotational movement by at least one adjacent panel member with respect to the other about the longitudinal axis of the elongate hinge members. When the system 10 or 10' is fully assembled, one adjacent display panel is rotationally movable in an arcuate path about the longitudinal axis of a the other adjacent display panel. Thus, the extent of the arcuate path being from a first position wherein a first longitudinally-extending side of a first display panel member is adjacent and substantially parallel to a first longitudinally-extending side of a second display panel, to a second position wherein a first longitudinally-extending side of the first display panel is adjacent and substantially parallel to a second longitudinally-extending side of the second display panel.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A portable trade show display panel system comprising a plurality of adjacent positioned display panels, said system being readily manually transportable by an end user each of said display panels comprising:

panel member, each panel member comprising first and second substantially parallel longitudinally-extending sides and first and second substantially parallel laterally-extending end sections and being adjacent one another, wherein said first longitudinally-extending side of one said panel member is adjacent said second longitudinally-extending side of an adjacent said panel member;

elongate hinge members, each said elongate hinge member having a longitudinal axis and including means defining a longitudinally-extending channel, said elongate hinge members being attached to adjacent longitudinally-extending sides of said adjacent panel members for rotational movement by at least one of said adjacent panel members, with respect to the other adjacent panel member, about the longitudinal axis of said elongate hinge members;

a protective outer covering surrounding each said panel member and elongate hinge member wherein said panel members, and said elongate hinge members are not exposed during use, said protective outer covering being connected to said panel members by frictional engagement within said longitudinally-extending channel; and means for interconnecting adjacent display panels one to the other and thereby providing fixed, aligned positioning of said adjacent display panels one with respect to each other while also facilitating rotational movement of said adjacent display panels about the longitudinal axis of said elongate hinge members so that the portable trade show display panel system can be arranged in a stable upright position for visual inspection by trade show participants.

2. The system of claim 1, wherein said protective outer covering is connected to the panel members solely by frictional engagement with said elongate hinge members.

3. The system of claim 1, wherein said panel members comprise a lightweight rigid board material.

4. The system of claim 1, wherein said adjacent panel members include means defining grooves extending within at least one of the longitudinally-extending sides of said panel members for attachment of said elongate hinge members to said adjacent longitudinally-extending sides of said adjacent panel members for rotational movement by at least one adjacent panel member.

5. The system of claim 4, wherein said elongate hinge members include flange means which are attachable within said groove means to said longitudinally-extending sides of said panel members.

6. The system of claim 1, wherein said means for interconnecting said adjacent display panels one to the other comprises means for attaching the elongate hinge member of one said panel member to the elongate hinge member of an adjacent said panel member.

7. The system of claim 6, wherein said means for interconnecting said elongate hinge members of said adjacent display panels comprises fasteners secured to said elongate hinge members and link members connected to and joining said fasteners in adjacent said display panels one to the other.

8. The system of claim 7, wherein said elongate hinge members include means defining a longitudinally-extending elongate slot and said fasteners are sized to securely fit within said elongate slot means.

9. The system of claim 1, wherein said elongate hinge members include a plurality of longitudinally-extending elongate rib members located on an outer periphery of said elongate hinge members to facilitate the connection of said protective outer covering by frictional engagement to the panel members.

10. The system of claim 1, wherein said display panels further comprises a first and second parallel face wherein a first adjacent said display panel is rotationally movable in an arcuate path about the longitudinal axis of a second adjacent said display panel, the extent of said arcuate path being from a first position wherein said first face of said first display panel member is adjacent and substantially parallel to a first said of a second display panel, to a second position wherein the second face of the first display panel is adjacent and substantially parallel to the second face of the second display panel.

11. A method for producing a portable trade show display panel system including a plurality of display panels, said system being readily manually transportable by an end user and comprising providing a plurality of adjacent display, each said display panel comprising a panel member, each of said panel members comprising first and second substantially parallel longitudinally-extending sides and first and second substantially parallel laterally-extending end sections and being adjacent one another, wherein said first longitudinally-extending side of one said panel member is adjacent said second longitudinally-extending side of an adjacent said panel member;

proving elongated hinge members each of said elongate hinge members having a longitudinal axis and including means defining a longitudinally-extending channel attaching elongated hinge members to adjacent longitudinally-extending sides of said adjacent panel members for rotational movement by at least one adjacent panel member with respect to the other adjacent panel members about the longitudinal axis of said elongate hinge member attached thereto;

installing a protective outer covering surrounding each of said panel members and said elongate hinge members, wherein said panel members and said elongate hinge members are not exposed during use, said protective outer covering being connected to said panel members by frictional engagement within the confines of said longitudinally-extending slots; and interconnecting said display panels one to the other and thereby providing fixed, aligned positioning of said display panels one with respect to each other while also facilitating rotational movement of said display panels about the longitudinal axis of said elongate hinge members so that the portable trade show display panel system can be arranged in a stable upright position for visual inspection by trade show participants.

12. The method of claim 11, which further includes the step of connecting said protective outer covering to the panel members solely by frictional engagement with said elongate hinge members.

13. The method of claim 11, wherein said panel members comprise a lightweight rigid board material.

14. The method of claim 11, wherein said adjacent panel members include means defining grooves extending within at least one of the longitudinally-extending sides of said panel members for attachment of said elongate hinge members to said adjacent longitudinally-extending sides of said adjacent panel members for rotational movement by at least one adjacent panel member.

15. The method of claim 14, wherein said elongate hinge members include flange means which are attachable within said groove means to said longitudinally-extending sides of said panel members.

16. The method of claim 11, wherein said step of interconnecting said adjacent display panels one to the other comprises means for attaching the elongate hinge member of one panel member to the elongate hinge member of an adjacent panel member.

17. The method of claim 16, wherein said step of interconnecting said elongate hinge members of said adjacent display panels comprises fasteners secured to said elongate hinge members and link members connected to and joining said fasteners in adjacent display panels one to the other.

18. The method of claim 17, wherein said elongate hinge members include means defining a longitudinally-extending elongate slot and said fasteners are sized to securely fit within said elongate slot means.

19. The method of claim 11, wherein said elongate hinge members include a plurality of longitudinally-extending elongate rib members located on an outer periphery of said elongate hinge members to facilitate the connection of said protective outer covering by frictional engagement to the panel members.

20. The method of claim 11, wherein said display panels further comprises a first and second parallel face, wherein a first adjacent said display panel is rotationally movable in an arcuate path about the longitudinal axis of a second adjacent said display panel, the extent of said arcuate path being from a first position wherein said first face of said first display panel member is adjacent and substantially parallel to a first face of a second display panel, to a second position wherein the second face of the first display panel is adjacent and substantially parallel to the second face of the second display panel.

21. A portable trade show display panel for use in a portable trade show display panel system, which comprises a panel member having first and second substantially parallel longitudinally-extending sides and first and second substantially parallel laterally-extending end sections and being adjacent one another, wherein said first longitudinally-extending side of one said panel member is adjacent said second longitudinally-extending side of an adjacent said panel member; elongate hinge members, each said elongate hinge member having a longitudinal axis and including means defining a longitudinally-extending channel, said elongate hinge members being attached to said adjacent longitudinally-extending sides of said adjacent panel members for rotational movement by at least one said adjacent panel member with respect to the other about the longitudinal axis of said elongate hinge members; and a protective outer covering surrounding each said panel member and elongate hinge member wherein said panel member and said elongate hinge members are not exposed during use, said protective outer covering being connected to said panel members by frictional engagement with said elongate hinge members.

22. The display panel of claim 21, wherein said protective outer covering is connected to the panel members solely by frictional engagement with said elongate hinge members.

23. The display panel of claim 21, wherein said panel members comprise a lightweight rigid board material.

24. The display panel of claim 21, wherein said adjacent panel members include means defining grooves extending within at least one of the longitudinally-extending sides of said panel members for attachment of said elongate hinge members to said adjacent longitudinally-extending sides of said adjacent panel members for rotational movement by at least one adjacent panel member.

25. The display panel of claim 24, wherein said elongate hinge members include flange means which are attachable within said groove means to said longitudinally-extending sides of said panel members.

26. The display panel of claim 21, wherein said elongate hinge members include a plurality of longitudinally-extending elongate rib members located on an outer periphery of said elongate hinge members to facilitate the connection of said protective outer covering by frictional engagement to the panel members.

27. The display panel of claim 21 wherein said display panels further comprises a first and second parallel face, wherein a first adjacent said display panel is rotationally movable in an arcuate path about the longitudinal axis of a second adjacent said display panel, the extent of said arcuate path being from a first position wherein said first face of said first display panel member is adjacent and substantially parallel to a first face of a second display panel, to a second position wherein the second face side of the first display panel is adjacent and substantially parallel to the second face of the second display panel.

* * * * *